US011179769B2

(12) United States Patent
Bullied et al.

(10) Patent No.: US 11,179,769 B2
(45) Date of Patent: Nov. 23, 2021

(54) INVESTMENT CASTING PIN AND METHOD OF USING SAME

(71) Applicant: United Technologies Corporation, Farmington, CT (US)

(72) Inventors: Steven J. Bullied, Pomfret Center, CT (US); Russell A. Beers, Manchester, CT (US); Mario P. Bochiechio, Vernon, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 0 days.

(21) Appl. No.: 16/271,293

(22) Filed: Feb. 8, 2019

(65) Prior Publication Data

US 2020/0254511 A1 Aug. 13, 2020

(51) Int. Cl.

| | |
|---|---|
| ***B22C 21/14*** | (2006.01) |
| ***B22C 9/10*** | (2006.01) |
| ***B22D 29/00*** | (2006.01) |

(52) U.S. Cl.

CPC ..... *B22C 21/14* (2013.01); *B22C 9/10* (2013.01); *B22D 29/002* (2013.01)

(58) Field of Classification Search

CPC ..... B22C 9/10; B22C 9/108; B22C 21/14; B22C 1/00; B22C 7/02; B22C 9/04; B22C 9/24; B22D 29/00; B22D 29/001; B22D 29/002

USPC ..... 164/132, 369, 397, 398, 399, 400

See application file for complete search history.

(56) References Cited

U.S. PATENT DOCUMENTS

| | | | | |
|---|---|---|---|---|
| 4,986,333 | A | 1/1991 | Gartland | |
| 7,036,556 | B2 | 5/2006 | Caputo et al. | |
| 7,779,892 | B2 * | 8/2010 | Luczak et al. | B22C 9/10 164/235 |
| 7,802,613 | B2 * | 9/2010 | Bullied et al. | B22C 3/00 164/369 |
| 8,096,343 | B2 | 1/2012 | Whitton | |
| 9,808,862 | B2 | 11/2017 | Verner et al. | |
| 2006/0021730 | A1 | 2/2006 | Marcin, Jr. | |
| 2010/0139586 | A1 | 6/2010 | Kazuo | |
| 2012/0168108 | A1 | 7/2012 | Farris | |
| 2015/0285097 | A1 | 10/2015 | Spangler | |

OTHER PUBLICATIONS

EP search report for EP20156298.0 dated Apr. 28, 2020.

* cited by examiner

*Primary Examiner* — Kevin P Kerns
(74) *Attorney, Agent, or Firm* — Getz Balich LLC

(57) ABSTRACT

A method of forming a component by investment casting includes disposing at least a portion of an investment casting pin within a core. The investment casting pin includes a ceramic base pin having a perimeter and a length extending perpendicular to the perimeter and a sacrificial coating disposed about the perimeter of the ceramic base pin along at least a portion of the length of the ceramic base pin. A metal casting is formed around the core. The core and the sacrificial coating are leached with a leaching solution and the investment casting pin is removed from the metal casting.

15 Claims, 7 Drawing Sheets

INVESTMENT CASTING PIN AND METHOD OF USING SAME

BACKGROUND

1. Technical Field

This disclosure relates generally to methods and apparatus for investment casting, and more particularly to investment casting pins.

2. Background Information

Investment casting is a known technique for forming metallic components having complex geometries, especially hollow components, and may be used in the fabrication of gas turbine engine components.

During investment casting, a precursor ceramic form is created that defines the internal passages of the component to be manufactured. Metal will be cast around this form and the ceramic core will then be chemically removed in a caustic (i.e., leaching) solution resulting in the empty internal passage feature.

Turbine engine components, such as advanced airfoil designs, have cooling passages which inherently have complicated internal shapes. Design features may be included to stabilize the ceramic core during the casting process. For example, silica and quartz pins are used on many core designs to stabilize the core and connect the serpentine passages to the tip features of the ceramic core. However, the pin strength of silica and quartz pins may be inadequate with the tooling methods currently being used to manufacture advanced components.

Referring to FIG. 1, in some cases, alumina pins, such as investment casting pin 100, may be used where increased pin strength is desired. For example, during the investment casting process, the investment casting pin 100 may be inserted into a core 300, when manufacturing a component 36, to stabilize the core 300 and/or form a passage 38 within the component 36. Following formation of a metal casting 40, the metal casting 40 may, therefore, include the passage 38 defined by the investment casting pin 100. The core 300 is then leached from the component 36 using one or more processes known in the art. However, leaching and removal of high-strength ceramic pins (e.g., alumina pins), such as investment casting pin 100, may be difficult, requiring longer and additional leaching cycles at higher temperatures, thereby slowing manufacturing of components 36.

SUMMARY

According to an embodiment of the present disclosure, an investment casting pin is provided. The investment casting pin includes a ceramic base pin having a perimeter and a length extending perpendicular to the perimeter. A sacrificial coating is disposed about the perimeter of the ceramic base pin along at least a portion of the length of the ceramic base pin.

In the alternative or additionally thereto, in the foregoing embodiment, the ceramic base pin is made of alumina.

In the alternative or additionally thereto, in the foregoing embodiment, the sacrificial coating is configured to be removed from the ceramic base pin, at least in part, in the presence of a leaching solution.

In the alternative or additionally thereto, in the foregoing embodiment, the sacrificial coating is a silica coating.

In the alternative or additionally thereto, in the foregoing embodiment, the sacrificial coating is disposed about the perimeter of the ceramic base pin along the entire length of the ceramic base pin.

In the alternative or additionally thereto, in the foregoing embodiment, the sacrificial coating has a thickness of between 0.001 and 0.050 inches.

According to another embodiment of the present disclosure, an investment casting system is provided. The investment casting system includes an investment casting pin and a core. The investment casting pin includes a ceramic base pin having a perimeter and a length extending perpendicular to the perimeter. A sacrificial coating is disposed about the perimeter of the ceramic base pin along at least a portion of the length of the ceramic base pin. At least a portion of the investment casting pin is disposed within the core.

In the alternative or additionally thereto, in the foregoing embodiment, the ceramic base pin is made of alumina.

In the alternative or additionally thereto, in the foregoing embodiment, the sacrificial coating is configured to be removed from the ceramic base pin, at least in part, in the presence of a leaching solution.

In the alternative or additionally thereto, in the foregoing embodiment, the sacrificial coating is a silica coating.

In the alternative or additionally thereto, in the foregoing embodiment, the sacrificial coating is disposed about the perimeter of the ceramic base pin along the entire length of the ceramic base pin.

According to another aspect of the present disclosure, a method of forming a component by investment casting is disclosed. At least a portion of an investment casting pin is disposed within a core. The investment casting pin includes a ceramic base pin having a perimeter and a length extending perpendicular to the perimeter and a sacrificial coating disposed about the perimeter of the ceramic base pin along at least a portion of the length of the ceramic base pin. A metal casting is formed around the core. The core and the sacrificial coating are leached with a leaching solution and the investment casting pin is removed from the ceramic base pin.

In the alternative or additionally thereto, in the foregoing embodiment, the component is an airfoil.

In the alternative or additionally thereto, in the foregoing embodiment, the ceramic base pin is made of alumina.

In the alternative or additionally thereto, in the foregoing embodiment, the sacrificial coating is configured to be removed from the ceramic base pin, at least in part, in the presence of a leaching solution.

In the alternative or additionally thereto, in the foregoing embodiment, the sacrificial coating is a silica coating.

In the alternative or additionally thereto, in the foregoing embodiment, the sacrificial coating is disposed about the perimeter of the ceramic base pin along the entire length of the ceramic base pin.

In the alternative or additionally thereto, in the foregoing embodiment, the perimeter of the investment casting pin defines a passage through at least a portion of the metal casting.

In the alternative or additionally thereto, in the foregoing embodiment, at least a portion of the leaching solution flows through the passage when leaching the core.

In the alternative or additionally thereto, in the foregoing embodiment, the metal casting is made of a single-crystal alloy.

The present disclosure, and all its aspects, embodiments and advantages associated therewith will become more readily apparent in view of the detailed description provided below, including the accompanying drawings.

DETAILED DESCRIPTION

Figure 1:
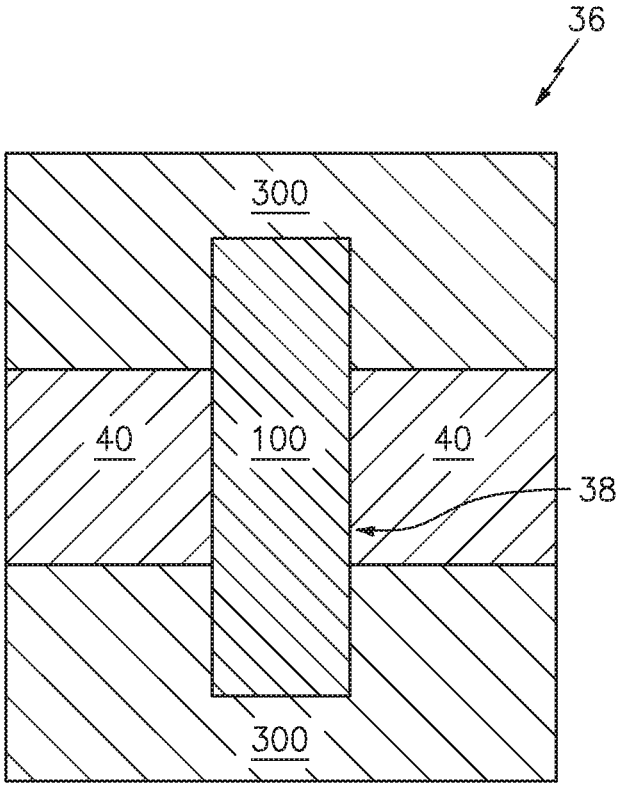
FIG. 1 (PRIOR ART)
FIG. 1 illustrates a side view of a conventional investment casting pin at a stage of the investment casting process.

It is noted that various connections are set forth between elements in the following description and in the drawings. It is noted that these connections are general and, unless specified otherwise, may be direct or indirect and that this specification is not intended to be limiting in this respect. A coupling between two or more entities may refer to a direct connection or an indirect connection. An indirect connection may incorporate one or more intervening entities. It is further noted that various method or process steps for embodiments of the present disclosure are described in the following description and drawings. The description may present the method and/or process steps as a particular sequence. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the description should not be construed as a limitation.

Figure 2:
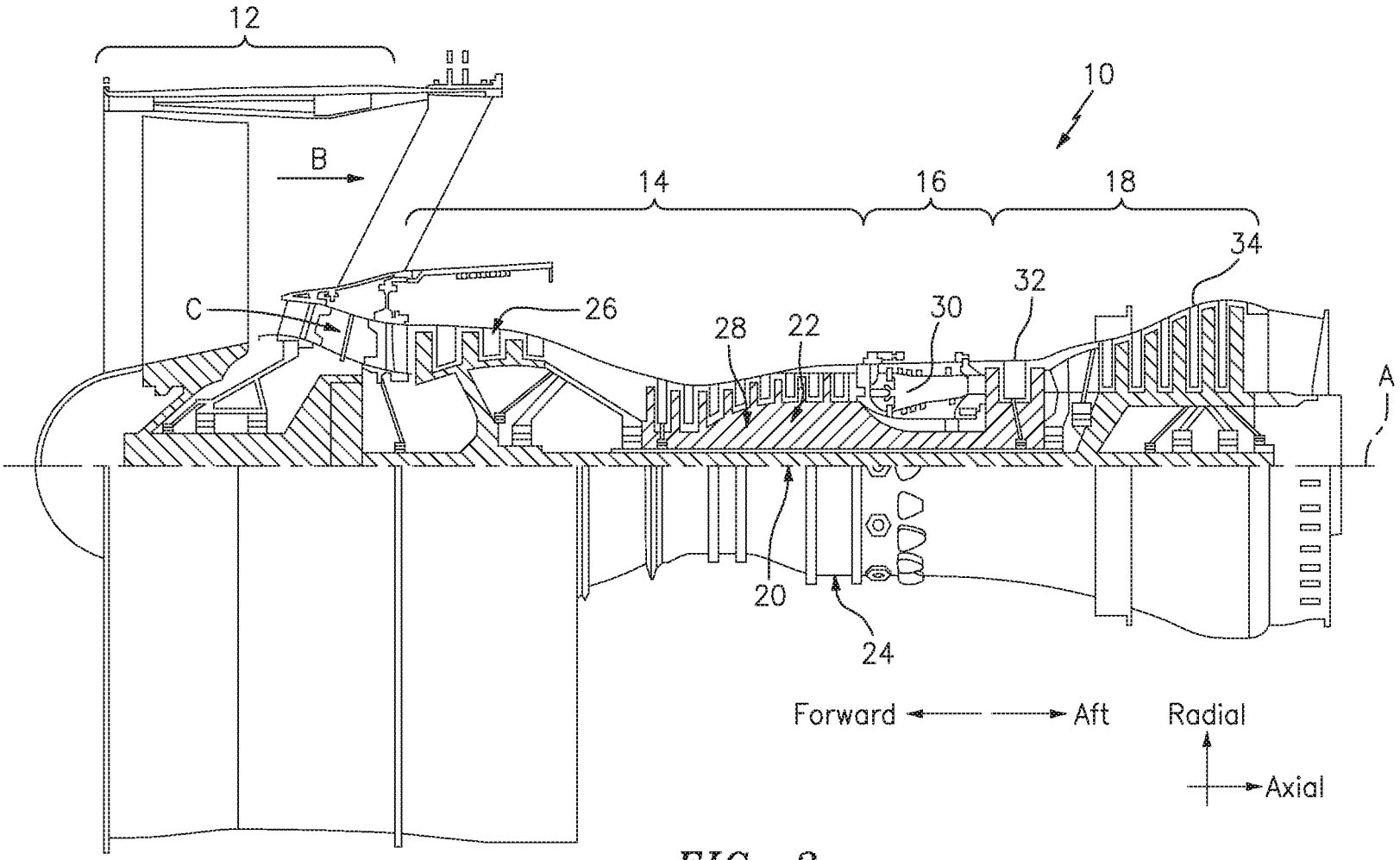
FIG. 2 is a side cross-sectional view of a portion of a gas turbine engine.

Referring to FIG. 2, to facilitate the description of the present disclosure, a two-spool turbofan type gas turbine engine 10 is shown. This exemplary embodiment of a gas turbine engine includes a fan section 12, a compressor section 14, a combustor section 16, and a turbine section 18. The fan section 12 drives air along a bypass flow path B in a bypass duct, while the compressor section 14 drives air along a core flow path C for compression and communication into the combustor section 16 then expansion through the turbine section 18.

The exemplary gas turbine engine 10 includes a low-speed spool 20 and a high-speed spool 22 mounted for rotation about an engine central longitudinal axis A relative to an engine static structure 24. Core airflow is compressed by the low-pressure compressor 26 then the high-pressure compressor 28, mixed and burned with fuel in the combustor 30, then expanded over the high-pressure turbine 32 and low-pressure turbine 34. The turbines 32, 34 rotationally drive the respective low-speed spool 20 and high-speed spool 22 in response to the expansion.

Core airflow increases in temperature as it travels through the gas turbine engine 10. A variety of components that are exposed to high-temperature air are often cooled by lower-temperature air (e.g., bypass air flow B) passing through cooling passages or ducts formed within or between components. Many of these "cooled" components are produced using an investment casting process and include interior cavities for receiving cooling air. To facilitate the description of the present disclosure provided below, the present disclosure will be described in terms of producing a hollow airfoil such as a turbine blade or stator. The present disclosure is not, however, limited to these particular applications and can be used in the manufacture of a variety of different components. For example, cast components may be cast blades, vanes, blade outer air seals, other gas turbine engine components, and other hardware with internal passages.

Figure 3:
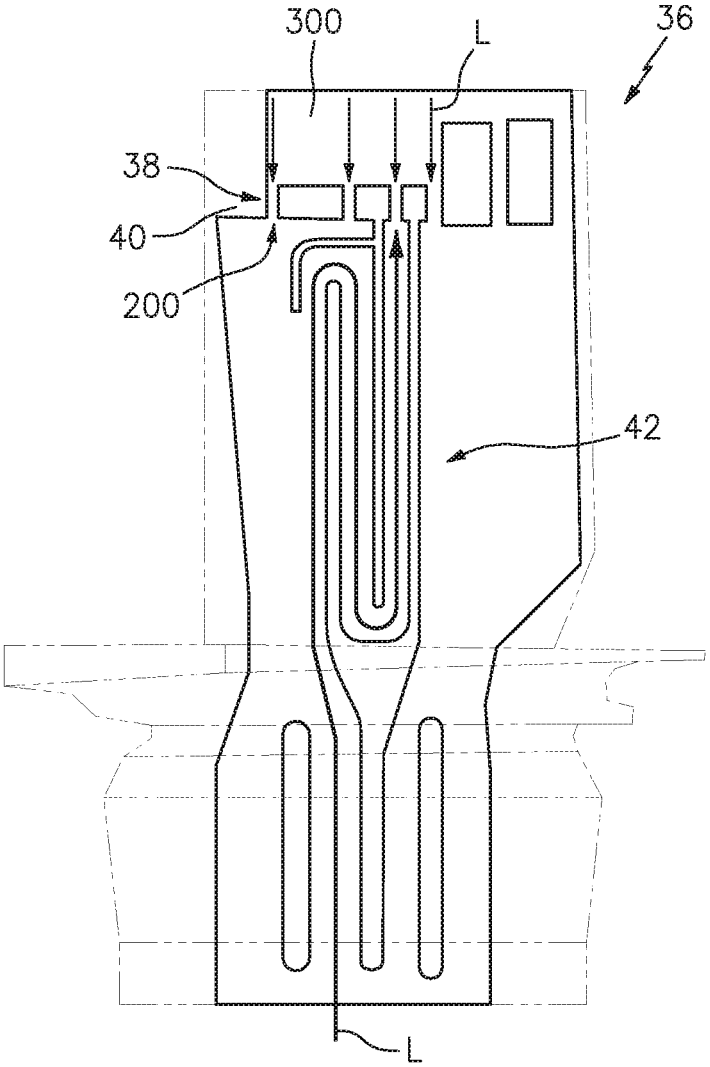
FIG. 3 illustrates a perspective cutaway view of a component at a stage of the investment casting process.

Referring to FIG. 3, a component 36, for example, an airfoil for a gas turbine engine, may be manufactured using an investment casting process. The present disclosure includes forming the component 36 having an interior geometry that corresponds to a core 300, i.e., the core 300 is the positive of the component 36 interior cavity 42. The core 300 is made from a material (e.g., a ceramic material) that is operable to be shaped in the desired form and can be subsequently leached from the component 36, as will be described below. As will be understood by those of ordinary skill in the art, the component 36 may be manufactured by forming a metal around the core 300 to create a metal casting 40.

As will be discussed in further detail, during the investment casting process, one or more investment casting pins 200 may be used to support the core 300, for example, the core 300 may be positioned within and spaced away from a mold (not shown), by connecting the core 300 to the mold. As shown in FIG. 3, the investment casting pin 200 may also be used to define one or more passages 38, such as cooling passages, within the metal casting 40. For example, a liquid metal may be poured between the core 300 and the mold and subsequently cooled to form the solid metal casting 40.

Figure 4A:
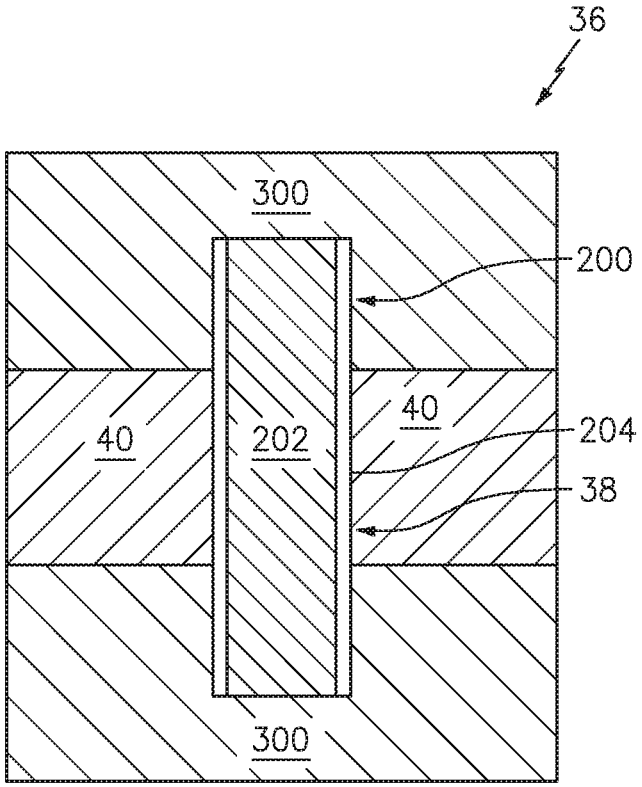
FIG. 4A illustrates a perspective view of an exemplary investment casting pin at a stage of the investment casting process.
Figure 5:
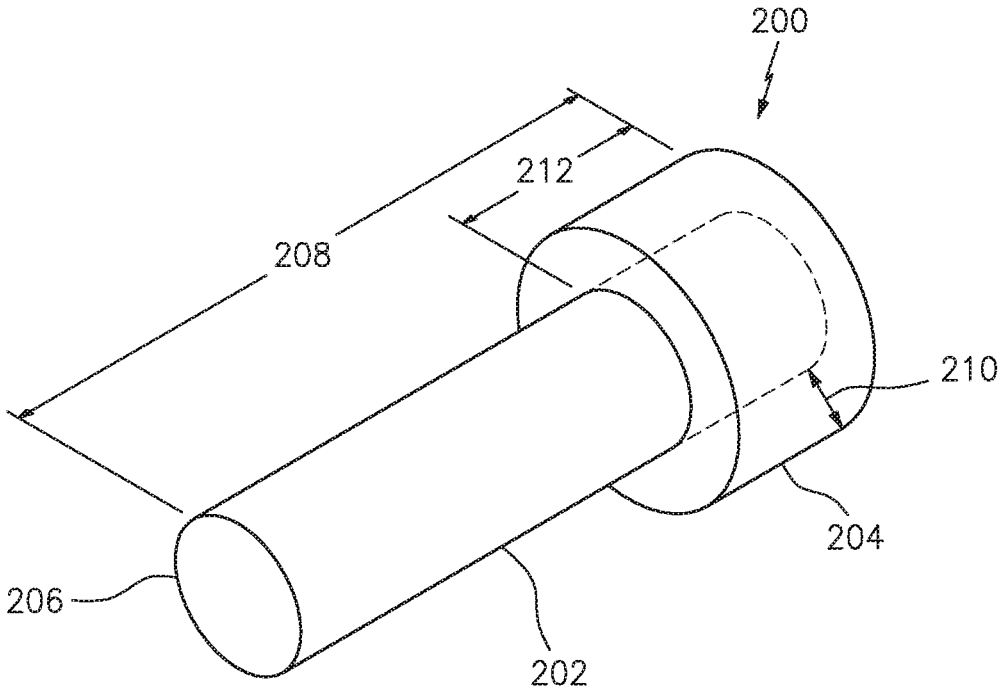
FIG. 5 illustrates a perspective view of the investment casting pin of FIG. 4A.
Figure 6:
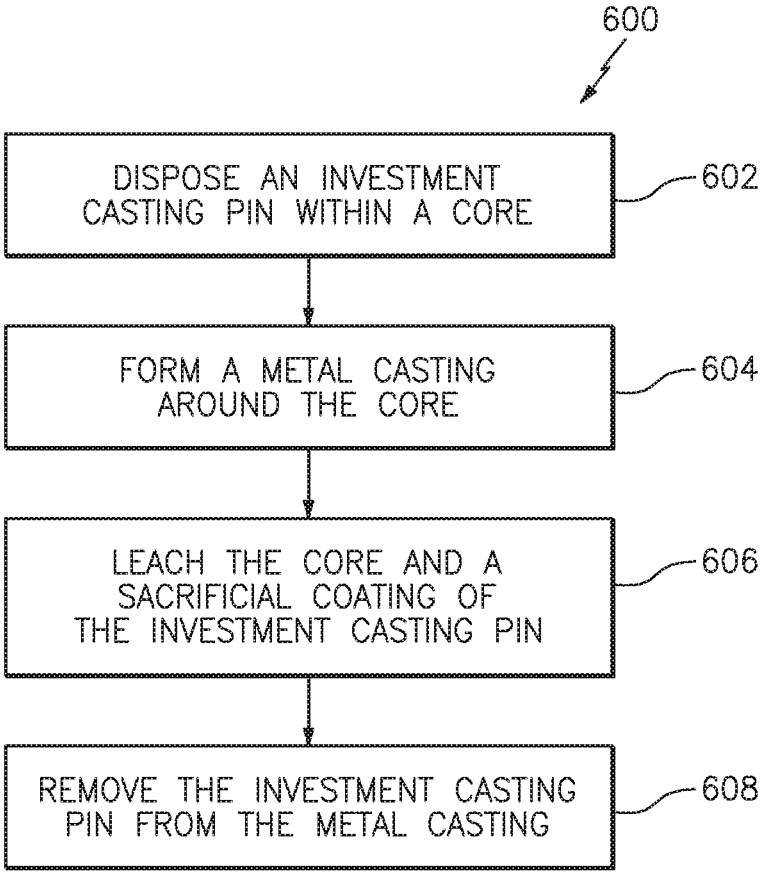
FIG. 6 illustrates a method of forming a component by investment casting.

Referring to FIGS. 4A and 5, the investment casting pin 200 includes a base pin 202. In some embodiments, the base pin 202 may be a ceramic shaft made of, for example, alumina. In some other embodiments, the base pin 202 may be made from other suitable high-strength materials resistant to leaching. The base pin 202 has a perimeter 206 and a length 208 which may extend generally perpendicular to the perimeter 206.

A sacrificial coating 204 is disposed about the perimeter 206 of the base pin 202 along at least a portion of the length 208 of the base pin 202. In other words, a length 212 of the sacrificial coating 204 may be less than or equal to the length 208 of the base pin 202. In some embodiments, the sacrificial coating 204 may be disposed about the perimeter 206 of the base pin 202 along the entire length 208 of the base pin 202. In some embodiments, the sacrificial coating 204 may be made of, for example, silica. The sacrificial coating 204 has a thickness 210, for example, between about 0.001 inches and 0.010 inches or between about 0.001 inches and 0.050 inches. In some embodiments, the thickness 210 of the sacrificial coating 204 may be inconsistent, for example, the thickness 210 in one portion of the sacrificial coating 204 may be greater or less than the thickness 210 in another portion of the sacrificial coating 204.

The sacrificial coating 204 is configured to be removed from the base pin 202, at least in part, in the presence of a leaching solution. For example, when applied to the investment casting pin 200, the leaching solution may caustically attack the sacrificial coating 204, thereby leaching the sacrificial coating 204 from the base pin 202. The term "leach," as used herein, refers to the process for transforming a leachable material, such as the sacrificial coating 204 and the core 300, to an alternative form (e.g., a liquid, a slurry, a gas, etc.) that can be removed from the leach-resistant materials, such as the metal casting 40 and the base pin 202, without damage to the leach-resistant materials. As an example, a material that can be formed as a solid and can be dissolved into liquid solution that is inert with respect to the leach-resistant materials, or that can be vaporized, or thermally melted, etc., would be a viable candidate as a leachable material.

Referring to FIGS. 3, 4A, 5, and 6, at least a portion of the investment casting pin 200 may be disposed in the core 300 (Step 602 of Method 600). In some embodiments, at least a portion of the pin may be disposed in the core 300 and a mold (not shown) so as to support the core 300 by connecting the core 300 to the mold. In some embodiments, the investment casting pin 200 may be disposed within the core 300 during the formation of the core 300, for example, prior to core 300 firing process. The metal casting 40 may be created by forming the metal casting 40 around the core 300 (Step 604). For example, a liquid metal may be poured or injected into the interior cavity 42 defined by the core 300, mold, and/or investment casting pins 200. In some embodiments, the perimeter 206 of the investment casting pin 200 defines a passage 38 through at least a portion of the metal casting 40.

Once the metal casting 40 has been formed, the core 300 and investment casting pins 200 are removed from the metal casting 40. The core 300 and the sacrificial coating 204 of the investment casting pin 200 are leached with a leaching solution (Step 606). The leaching solution caustically attacks the material of the core 300 and sacrificial coating 204 thereby allowing their removal from the metal casting 40 while leaving the metal casting 40 intact. Leaching solutions may include, for example, quantities of Potassium Hydroxide (KOH), Sodium Hydroxide (NaOH), or any other suitable leaching agent, in varying concentrations. For example, in some embodiments, the leaching solution may include 22.5% or 45% KOH or NaOH. In some other embodiments, leaching solutions may generally be about 10-60% caustic.

Figure 4B:
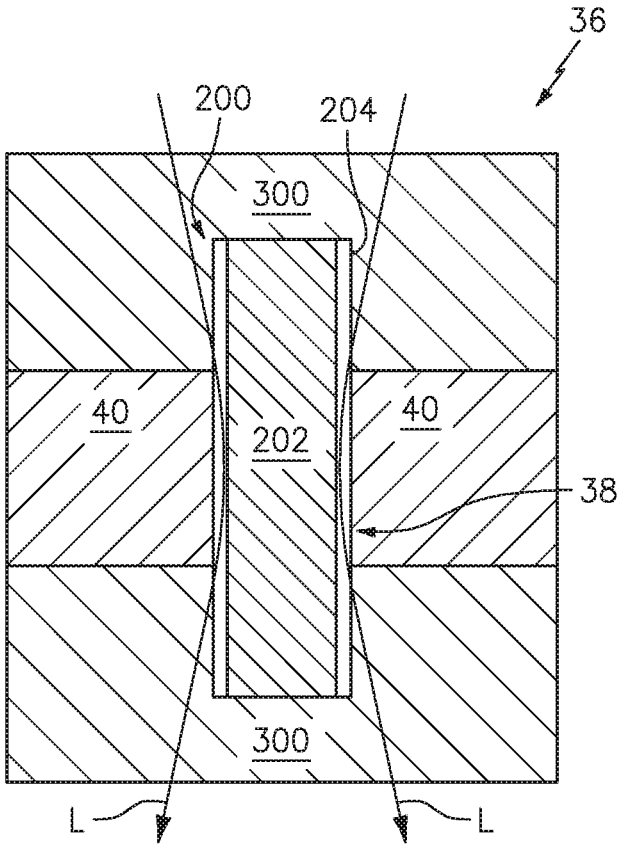
FIG. 4B illustrates the investment casting pin of FIG. 4A at another stage of the investment casting process.

Referring to FIGS. 3 and 4B, exemplary leaching flow paths L are illustrated showing a path of caustic attack the leaching solution may take during the leaching cycle. As shown in FIG. 4B, simultaneous leaching of the sacrificial coating 204 and the core 300 may allow at least a portion of the leaching solution to flow through the passage 38 when leaching the core 300, thereby enabling leaching of the core 300 from one or more additional directions. Accordingly, the route of the leaching solution to caustically attack the core 300 may be shortened, enabling more direct leaching of the core 300. As a result, complete leaching of the core 300 from the metal casting 40 may require fewer leaching cycles.

Referring again to FIGS. 3, 4A, 5, and 6, the investment casting pin 200 may be removed from the metal casting 40 once the sacrificial coating 204 has been sufficiently leached (i.e., at least a portion of the sacrificial coating 204 has been leached) (Step 608). Because the base pin 202 of the investment casting pin 200 can be manually removed from the metal casting 40, leaching of the base pin 202 of the investment casting pin 200 may not be necessary. Leaching of high-strength investment casting pins, for example, those made of alumina, may require more extreme leaching conditions (e.g., higher temperatures and concentrations of leaching agents), which present a risk of damage to the metal casting 40 (e.g., by caustic attack). Thus, leaching of the sacrificial coating 204 followed by manual removal of the base pin 202 from the casting 40 may permit leaching of the core 300 at conditions less likely to damage the metal casting 40.

While various aspects of the present disclosure have been disclosed, it will be apparent to those of ordinary skill in the art that many more embodiments and implementations are possible within the scope of the present disclosure. For example, the present disclosure as described herein includes several aspects and embodiments that include particular features. Although these particular features may be described individually, it is within the scope of the present disclosure that some or all of these features may be combined with any one of the aspects and remain within the scope of the present disclosure. Accordingly, the present disclosure is not to be restricted except in light of the attached claims and their equivalents.

What is claimed is:

1. A method of forming a component by investment casting, the method comprising:

disposing at least a portion of an investment casting pin within a core, the investment casting pin comprising a ceramic base pin having a perimeter and a length extending perpendicular to the perimeter and a sacrificial coating disposed about the perimeter of the ceramic base pin along at least a portion of the length of the ceramic base pin;

forming a metal casting around the core;

leaching the core and the sacrificial coating with a leaching solution, the ceramic base pin being resistant to leaching by the leaching solution; and manually removing the investment casting pin from the metal casting subsequent to leaching at least a portion of the sacrificial coating with the leaching solution, wherein the ceramic base pin is made of alumina.

2. The method of claim 1, wherein the component is an airfoil.

3. The method of claim 1, wherein the sacrificial coating is configured to be removed from the ceramic base pin, at least in part, in the presence of a leaching solution.

4. The method of claim 1, wherein the sacrificial coating is a silica coating.

5. The method of claim 1, wherein the sacrificial coating is disposed about the perimeter of the ceramic base pin along the entire length of the ceramic base pin.

6. The method of claim 1, wherein the perimeter of the investment casting pin defines a passage through at least a portion of the metal casting.

7. The method of claim 6, wherein at least a portion of the leaching solution flows through the passage when leaching the core.

8. The method of claim 1, wherein the metal casting is made of a single-crystal alloy.

9. The method of claim 1, wherein a first portion of the sacrificial coating has a first thickness and a second portion of the sacrificial coating has a second thickness which is different than the first thickness.

10. The method of claim 1, wherein the sacrificial coating is disposed about the perimeter of the ceramic base pin along a second length which is less than the length of the ceramic base pin.

11. A method of forming a component by investment casting, the method comprising:

disposing at least a portion of an investment casting pin within a core, the investment casting pin comprising a ceramic base pin having a perimeter and a length extending perpendicular to the perimeter and a sacrificial coating disposed about the perimeter of the ceramic base pin along at least a portion of the length of the ceramic base pin;

forming a metal casting around the core, the investment casting pin defining a passage within the metal casting;

leaching the core and the sacrificial coating with a leaching solution without leaching the ceramic base pin;

directing at least a first portion of the leaching solution into the metal casting in a first direction, through the passage between the ceramic base pin and the metal casting, and a second portion of the leaching solution into the metal casting in a second direction, different than the first direction; and removing the investment casting pin from the metal casting, wherein the ceramic base pin is made of alumina.

12. The method of claim 11, wherein the sacrificial coating is a silica coating.

13. The method of claim 11, wherein the sacrificial coating is disposed about the perimeter of the ceramic base pin along the entire length of the ceramic base pin.

14. The method of claim 11, wherein a first portion of the sacrificial coating has a first thickness and a second portion of the sacrificial coating has a second thickness which is different than the first thickness.

15. The method of claim 11, wherein the sacrificial coating is disposed about the perimeter of the ceramic base pin along a second length which is less than the length of the ceramic base pin.

* * * * *